US009088067B2

(12) United States Patent
Wong et al.

(10) Patent No.: US 9,088,067 B2
(45) Date of Patent: Jul. 21, 2015

(54) COMMUNICATION DEVICE AND TUNABLE ANTENNA ELEMENT THEREIN

(71) Applicant: Acer Incorporated, Taipei Hsien (TW)

(72) Inventors: Kin-Lu Wong, Kaohsiung (TW); Shu-Chuan Chen, Kaohsiung (TW)

(73) Assignee: ACER INCORPORATED, Taipei Hsien (TW)

( * ) Notice: Subject to any disclaimer, the term of this patent is extended or adjusted under 35 U.S.C. 154(b) by 317 days.

(21) Appl. No.: 13/716,701

(22) Filed: Dec. 17, 2012

(65) Prior Publication Data

US 2014/0097994 A1 Apr. 10, 2014

(30) Foreign Application Priority Data

Oct. 4, 2012 (TW) ..... 101136632 A

(51) Int. Cl.

| | |
|---|---|
| ***H01Q 9/00*** | (2006.01) |
| ***H01Q 5/00*** | (2015.01) |
| ***H01Q 1/24*** | (2006.01) |
| ***H01Q 9/04*** | (2006.01) |
| ***H01Q 5/30*** | (2015.01) |

(52) U.S. Cl.

CPC ..... *H01Q 5/0024* (2013.01); *H01Q 1/243* (2013.01); *H01Q 5/30* (2013.01); *H01Q 9/04* (2013.01)

(58) Field of Classification Search

CPC ..... H01Q 9/00
USPC ..... 343/750, 702, 700 MS
See application file for complete search history.

(56) References Cited

U.S. PATENT DOCUMENTS

| | | | | |
|---|---|---|---|---|
| 7,768,466 | B2 * | 8/2010 | Chi et al. | 343/741 |
| 7,978,141 | B2 * | 7/2011 | Chi et al. | 343/741 |
| 8,077,116 | B2 | 12/2011 | Shamblin et al. | |
| 8,593,348 | B2 * | 11/2013 | Krupa et al. | 343/700 MS |
| 8,816,920 | B2 * | 8/2014 | Abe et al. | 343/745 |
| 2007/0268191 | A1 | 11/2007 | Ishizuka et al. | |
| 2009/0128428 | A1 | 5/2009 | Ishizuka et al. | |
| 2009/0284433 | A1 * | 11/2009 | Tsutsumi et al. | 343/825 |
| 2011/0273360 | A1 * | 11/2011 | Campero et al. | 343/893 |
| 2012/0299781 | A1 * | 11/2012 | Lee | 343/700 MS |

FOREIGN PATENT DOCUMENTS

| | | |
|---|---|---|
| EP | 2 405 533 | 1/2012 |

OTHER PUBLICATIONS

European Search Report dated Nov. 27, 2013.

* cited by examiner

*Primary Examiner* — Huedung Mancuso
(74) *Attorney, Agent, or Firm* — McClure, Qualey & Rodack, LLP

(57) ABSTRACT

A communication device includes a ground element and an antenna element. The antenna element includes a first radiation element, a second radiation element, and a control circuit. One end of the first radiation element is coupled to a signal source, and another end of the first radiation element is an open end. The second radiation element includes at least a first portion and a second portion. A first end of the first portion is a shorted end coupled to the ground element, and a fourth end of the second portion is an open end. The second radiation element surrounds the open end of the first radiation element. The control circuit is coupled between a second end of the first portion and a third end of the second portion of the second radiation element. The control circuit provides at least two different impedances.

10 Claims, 6 Drawing Sheets

COMMUNICATION DEVICE AND TUNABLE ANTENNA ELEMENT THEREIN

CROSS REFERENCE TO RELATED APPLICATIONS

This Application claims priority of Taiwan Patent Application No. 101136632 filed on Oct. 4, 2012, the entirety of which is incorporated by reference herein.

BACKGROUND OF THE INVENTION

1. Field of the Invention

The disclosure generally relates to a communication device, and more particularly, relates to a communication device and a tunable antenna element therein.

2. Description of the Related Art

With recent, rapid development in wireless communication technology, a variety of wireless communication devices have been developed and marketed. Among them, the most popular are mobile communication devices. To satisfy the demands for slim profile and multiple functions, available space in mobile communication devices to accommodate internal antennas is becoming very limited. It is hence a challenge for an antenna designer to design an internal antenna capable of multiple functions having a very slim profile.

In order to solve the foregoing problems, there is a need to provide a communication device and a tunable antenna element therein, which can operate in different bands without changing the size of the antenna element.

BRIEF SUMMARY OF THE INVENTION

The invention is aimed to provide a communication device and a tunable antenna element therein. The antenna element comprises a control circuit for providing at least two different impedances. By adjusting the control circuit, resonant modes of the antenna element are controlled to cover different communication bands without changing the size of the antenna element. The tunable antenna element of the invention can cover multiple bands, for example, WWAN/LTE (Wireless Wide Area Network/Long Term Evolution) bands.

In a preferred embodiment, the invention is directed to a communication device, comprising: a ground element; and an antenna element, comprising: a first radiation element, wherein one end of the first radiation element is coupled to a signal source, and another end of the first radiation element is an open end; a second radiation element, comprising at least a first portion having a first end and a second end, and a second portion having a third end and a fourth end, wherein the first end of the first portion of the second radiation element is a shorted end coupled to the ground element, the fourth end of the second portion of the second radiation element is an open end, a length of the second radiation element is greater than a length of the first radiation element, and the second radiation element surrounds the open end of the first radiation element; and a control circuit, coupled between the second end of the first portion and the third end of the second portion of the second radiation element, wherein the control circuit provides at least two different impedances in such a manner that the antenna element operates in multiple bands.

In the invention, the control circuit is located in the second radiation element, and more particularly, is substantially located at a surface current null of a high-order resonant mode of the second radiation element. Accordingly, the frequency of the fundamental resonant mode of the second radiation element may be changed without affecting the high-order resonant mode thereof to cover different frequency ranges. In an embodiment, the control circuit comprises at least one capacitive element for providing at least two different capacitances. For example, the capacitive element is a variable capacitor. In another embodiment, the control circuit further comprises an inductive element which is coupled in series to the capacitive element. In an embodiment, the control circuit comprises a plurality of branches in parallel, and the branches comprise at least one capacitive element and at least one inductive element. For example, a first branch comprises the capacitive element, and a second branch comprises the inductive element, and a third branch is a shorted path. The control circuit selects one of the branches, and couples the first portion of the second radiation element through the selected branch to the second portion of the second radiation element.

In the above embodiment, the control circuit provides at least two different impedances to control the fundamental resonant mode of the second radiation element in such a manner that the fundamental resonant mode of the antenna element is capable of covering different frequency ranges. A change in the impedance (including a change in the capacitance or a change in the inductance) may cause a change in the phases of the surface currents on the second radiation element. Accordingly, the second radiation element may resonate at different frequencies and generate different resonant modes to cover multiple frequency ranges.

The antenna element operates in at least a first band and a second band, and the first band is lower than the second band. The first band is controlled by the control circuit so as to cover different frequency ranges. In a preferred embodiment, the first band covers a frequency range from about 700 MHz to 960 MHz, and the second band covers another frequency range from about 1710 MHz to 2690 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are shown in detail as follows.

Figure 1:
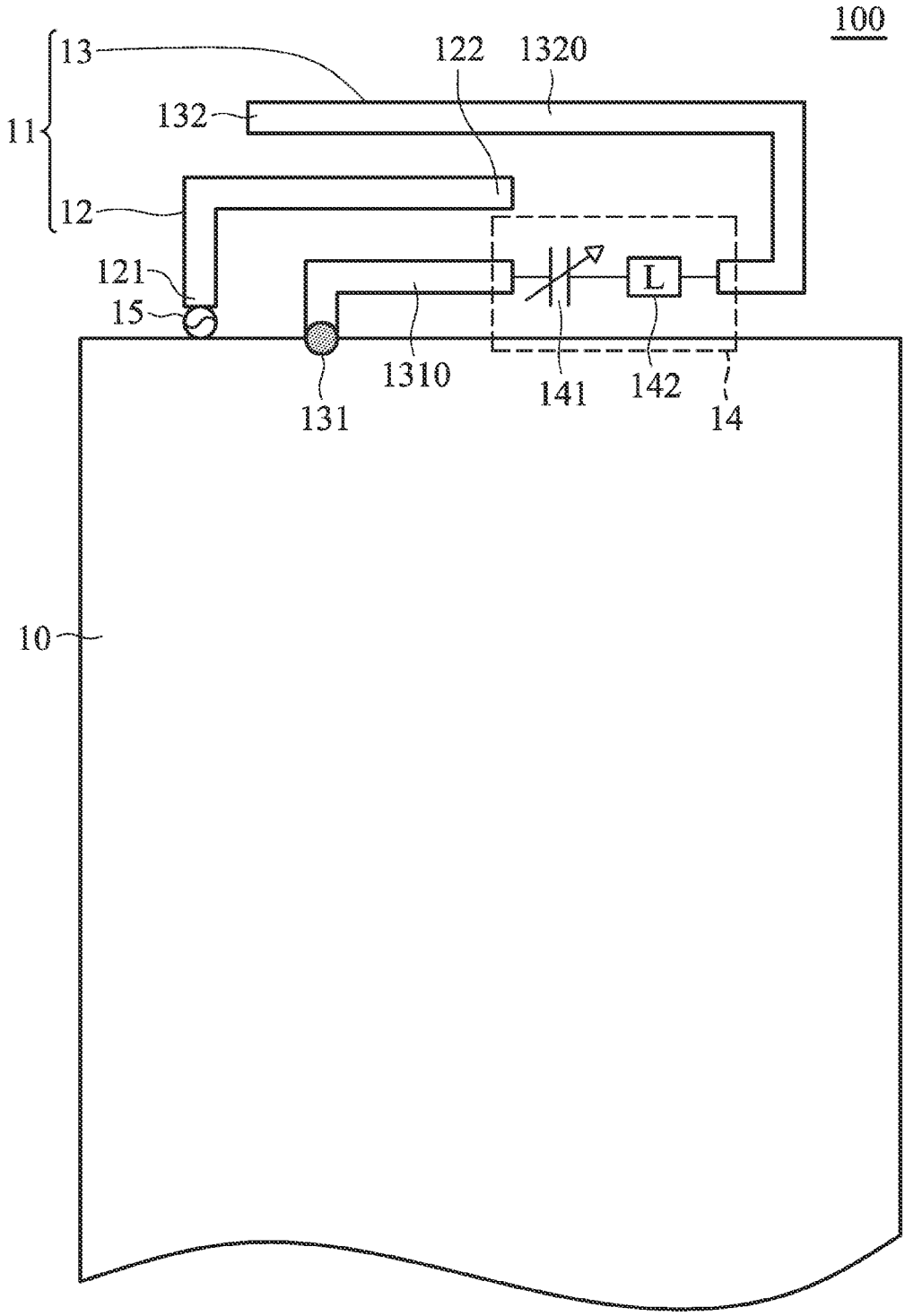
FIG. 1 is a diagram for illustrating a communication device according to a first embodiment of the invention.

FIG. 1 is a diagram for illustrating a communication device 100 according to a first embodiment of the invention. The communication device 100 may be a mobile phone, a tablet computer, or a notebook computer. As shown in FIG. 1, the communication device 100 comprises a ground element 10 and an antenna element 11. The antenna element 11 comprises a first radiation element 12, a second radiation element 13, and a control circuit 14. One end of the first radiation element 12 is a feeding end 121 coupled to a signal source 15, and another end of the first radiation element 12 is an open end 122. The second radiation element 13 comprises at least a first portion 1310 and a second portion 1320. The first portion 1310 has a first end and a second end. The second portion 1320 has a third end and a fourth end. The first end of the first portion 1310 of the second radiation element 13 is a shorted end 131 coupled to the ground element 10. The fourth end of the second portion 1320 of the second radiation element 13 is an open end 132. The length of the second radiation element 13 is greater than the length of the first radiation element 12. The second radiation element 13 surrounds the open end 122 of the first radiation element 12. The control circuit 14 is coupled between the second end of the first portion 1310 and the third end of the second portion 1320 of the second radiation element 13. The control circuit 14 provides at least two different impedances in such a manner that the antenna element 11 operates in multiple bands. The control circuit 14 is substantially located at a surface current null of a high-order resonant mode of the second radiation element 13. In some embodiments, the control circuit 14 comprises at least one capacitive element 141 for providing at least two different capacitances. The capacitive element 141 may be a variable capacitor. In some embodiments, the control circuit 14 further comprises at least one inductive element 142, and the capacitive element 141 is coupled in series to the inductive element 142 such that the resonant length of the second radiation element 13 is effectively reduced. The inductive element 142 may be a chip inductor. Note that the communication device 100 may further comprise other essential components, for example, a processor, a touch panel, a battery, and a housing (not shown).

Figure 2:
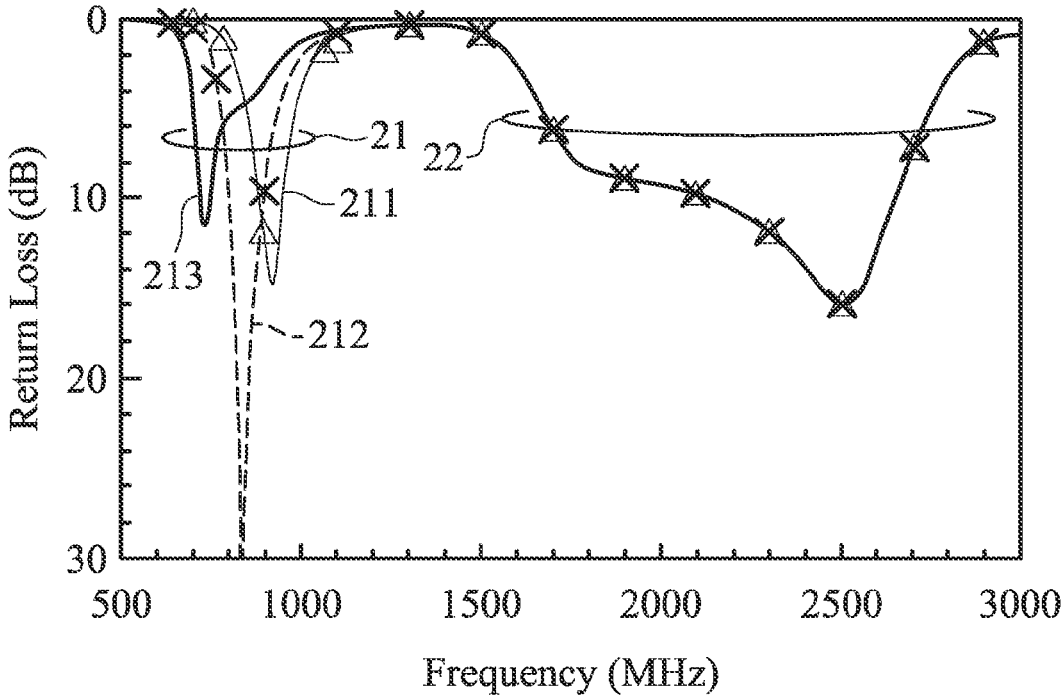
FIG. 2 is a diagram for illustrating return loss of an antenna element of a communication device according to a first embodiment of the invention.

FIG. 2 is a diagram for illustrating return loss of the antenna element 11 of the communication device 100 according to the first embodiment of the invention. In some embodiments, the element sizes and the element parameters of the communication device 100 are as follows. The ground element 10 has a length of about 103 mm and a width of about 60 mm. The antenna element 11 has a length of about 35 mm, a width of about 7 mm, and a height of about 3 mm (the antenna element 11 just has a volume of about 0.74 $cm^3$). The first radiation element 12 has a length of about 32 mm. The second radiation element 13 has a length of about 60 mm. The inductive element 142 has an inductance of about 10 nH.

The capacitive element 141 is a variable capacitor for providing at least two different capacitances. For example, a first capacitance is about 3 pF, and a second capacitance is about 5 pF, and a third capacitance is about 22 pF. The plurality of return loss curves in FIG. 2 correspond to different capacitances, respectively. As shown in FIG. 2, the antenna element 11 operates in a first band 21 and a second band 22, and the first band 21 is lower than the second band 22. The first band 21 is controlled by the control circuit 14 so as to cover a first frequency range 211, a second frequency range 212 and a third frequency range 213. The first frequency range 211 corresponds to the first capacitance and substantially covers a GSM900 band. The second frequency range 212 corresponds to the second capacitance and substantially covers a GSM850 band. The third frequency range 213 corresponds to the third capacitance and substantially covers an LTE700 band. In summary, the first band 21 of the antenna element 11 can cover different frequency ranges or different mobile communication bands from about 700 MHz to 960 MMz by switching between the three different capacitances of the capacitive element 141. In addition, the second band 22 of the antenna element 11 is substantially formed by a resonant mode of the first radiation element 12 and a high-order resonant mode of the second radiation element 13 to cover a frequency range from about 1710 MHz to 2690 MHz or to cover GSM1800/1900/UMTS/LTE2300/2500 (from about 1710 MHz to 2690 MHz) five bands.

Figure 3:
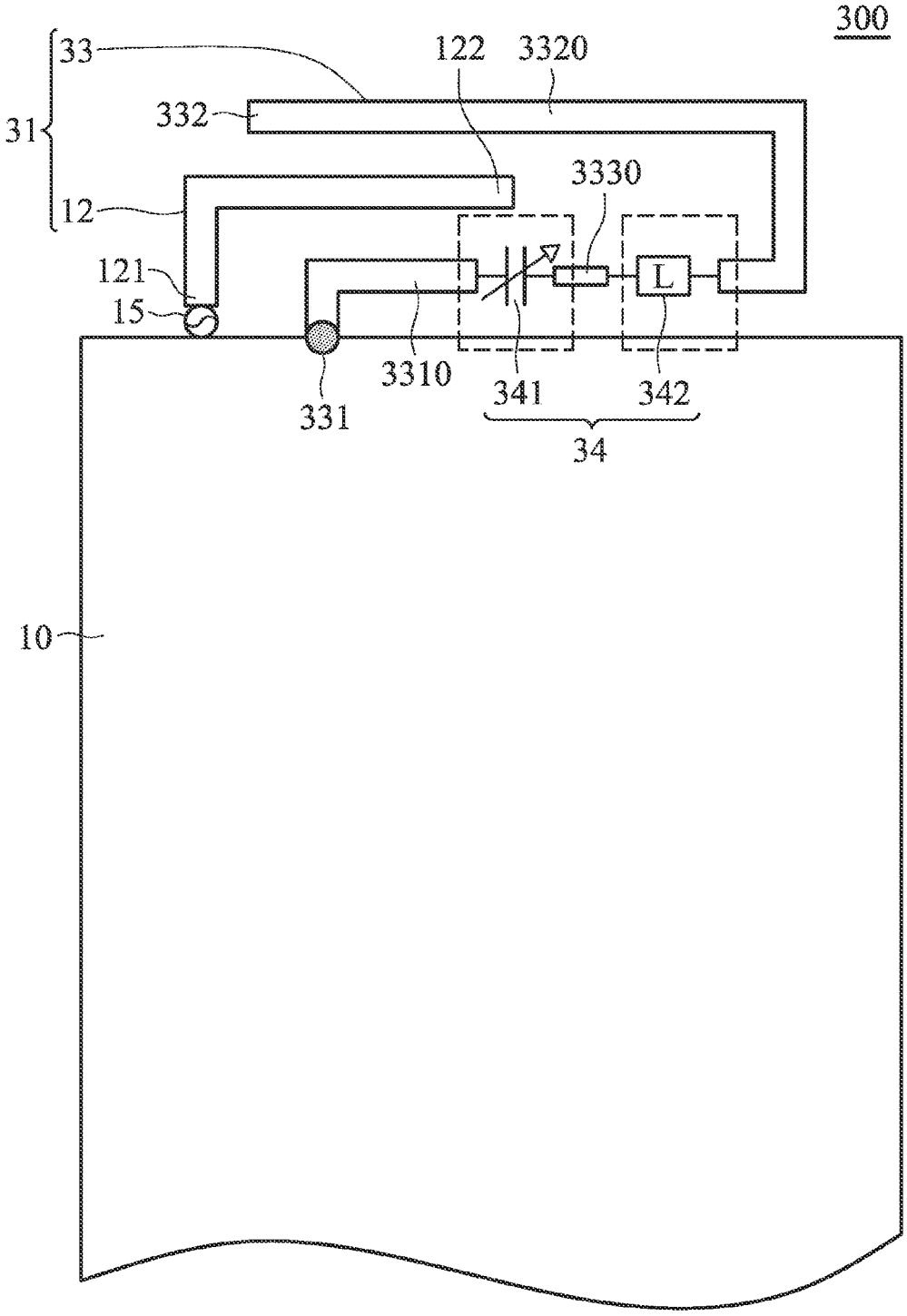
FIG. 3 is a diagram for illustrating a communication device according to a second embodiment of the invention.

FIG. 3 is a diagram for illustrating a communication device 300 according to a second embodiment of the invention. In the second embodiment, a control circuit 34 of the communication device 300 comprises a capacitive element 341 and an inductive element 342, and a second radiation element 33 of the communication device 300 comprises a first portion 3310, a second portion 3320, and a third portion 3330. The inductive element 342 is coupled in series through the third portion 3330 of the second radiation element 33 to the capacitive element 341. In addition, the control circuit 34 is coupled between the first portion 3310 and the second portion 3320 of the second radiation element 33. Other features of the communication device 300 in the second embodiment are similar to those in the first embodiment. Accordingly, the performance of the communication device 300 in the second embodiment is almost the same as that in the first embodiment.

Figure 4:
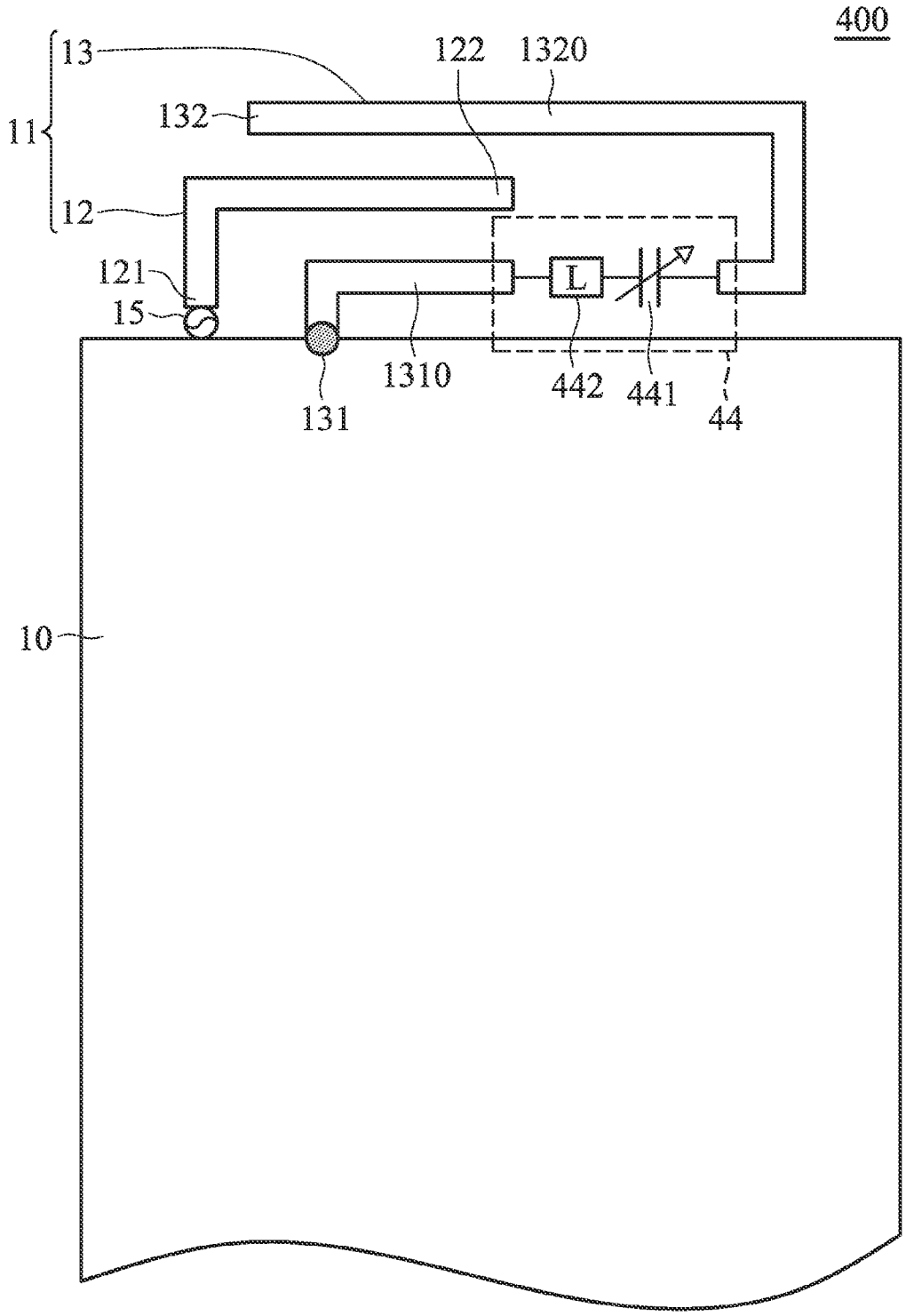
FIG. 4 is a diagram for illustrating a communication device according to a third embodiment of the invention.

FIG. 4 is a diagram for illustrating a communication device 400 according to a third embodiment of the invention. In the third embodiment, a control circuit 44 of the communication device 400 comprises an inductive element 442 and a capacitive element 441. In comparison to the first embodiment, the capacitive element 441 is interchanged with the inductive element 442. Other features of the communication device 400 in the third embodiment are similar to those in the first embodiment. Accordingly, the performance of the communication device 400 in the third embodiment is almost the same as that in the first embodiment.

Figure 5:
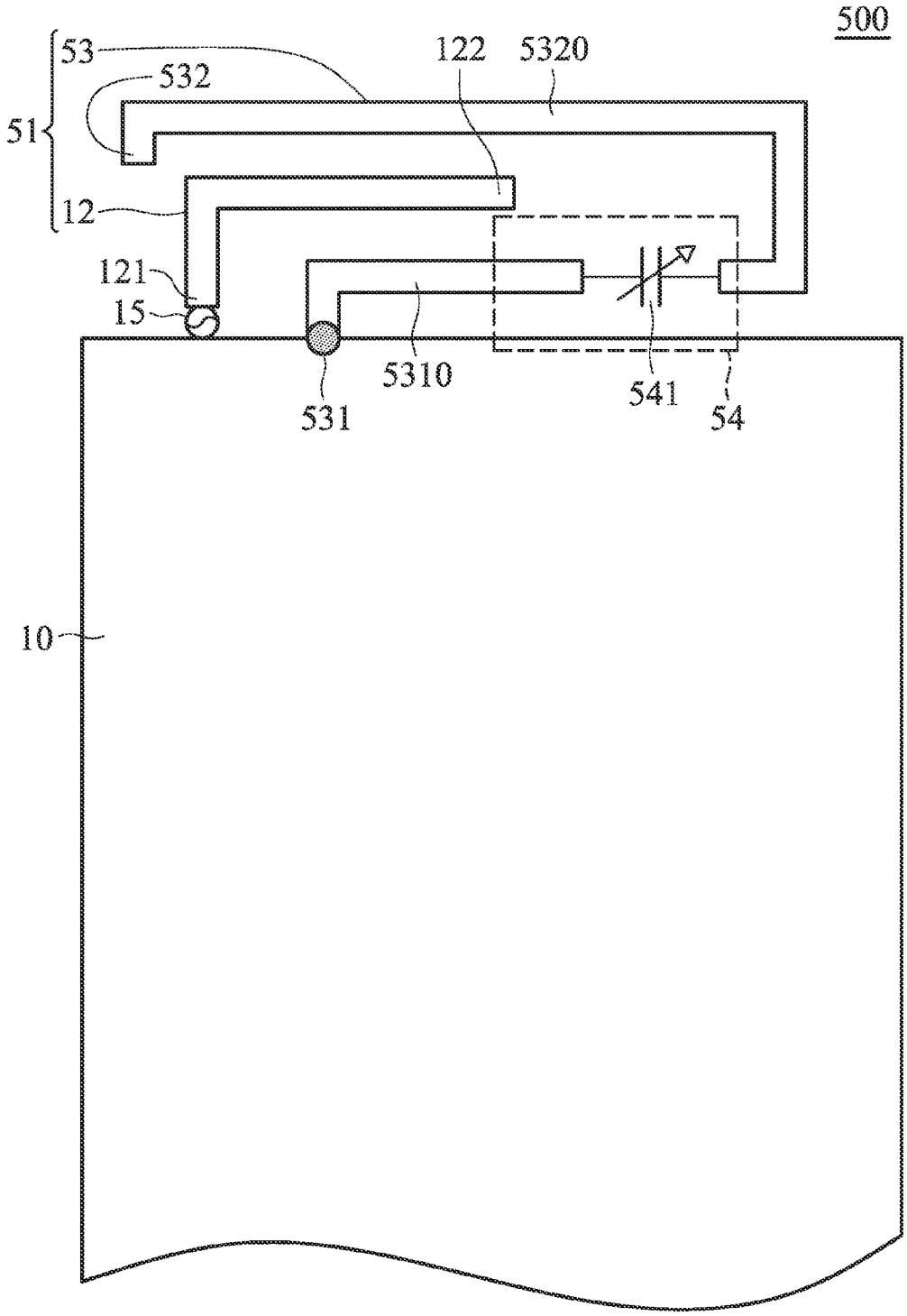
FIG. 5 is a diagram for illustrating a communication device according to a fourth embodiment of the invention.

FIG. 5 is a diagram for illustrating a communication device 500 according to a fourth embodiment of the invention. In the fourth embodiment, a control circuit 54 of the communication device 500 comprises only one capacitive element 541. No inductive element is included in the control circuit 54. In comparison to the first embodiment, the communication device 500 uses a longer second radiation element 53 to generate a similar low band. Other features of the communication device 500 in the fourth embodiment are similar to those in the first embodiment. Accordingly, the performance of the communication device 500 in the fourth embodiment is almost the same as that in the first embodiment.

Figure 6:
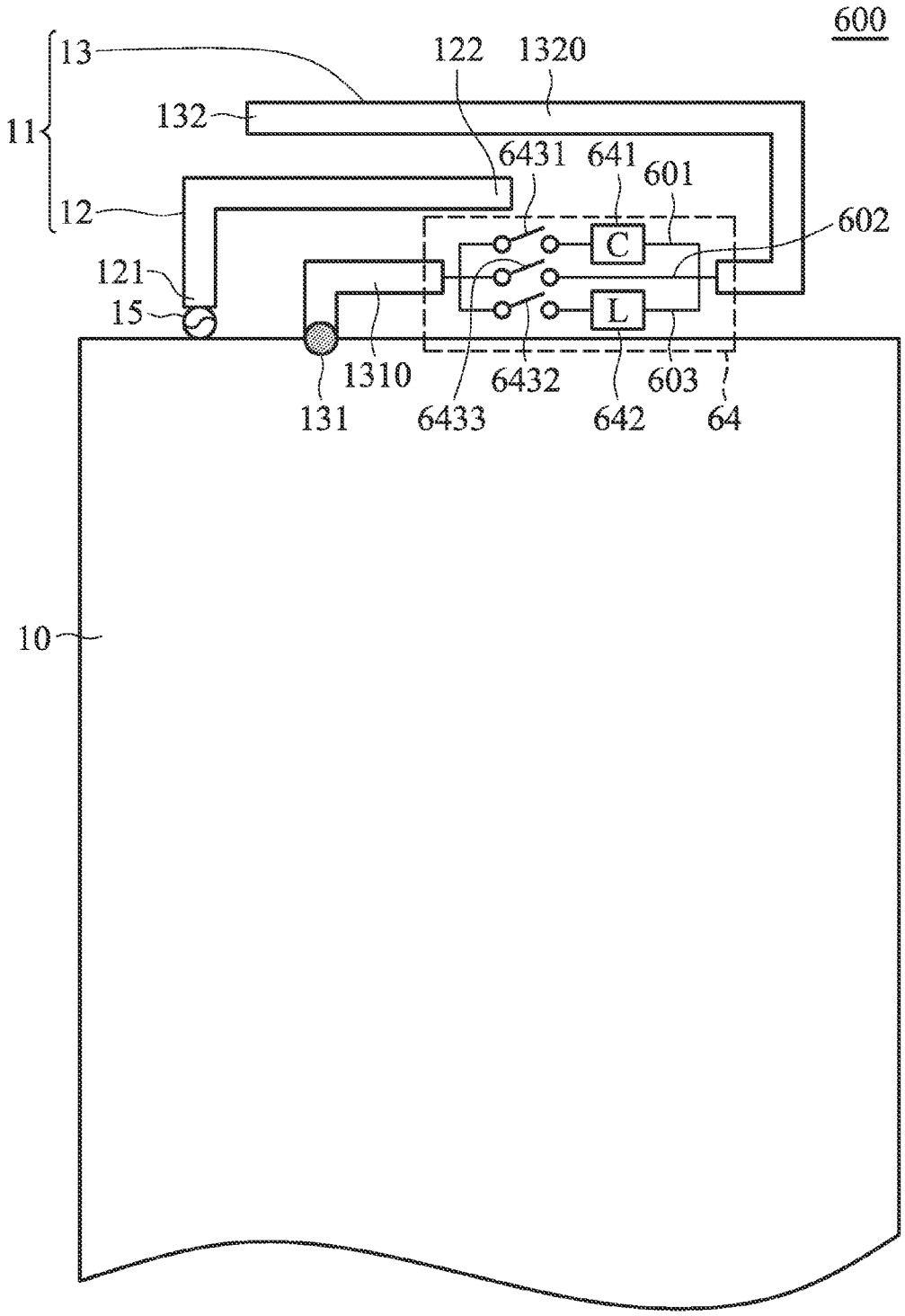
FIG. 6 is a diagram for illustrating a communication device according to a fifth embodiment of the invention.

FIG. 6 is a diagram for illustrating a communication device 600 according to a fifth embodiment of the invention. In the fifth embodiment, a control circuit 64 of the communication device 600 comprises a plurality of branches 601, 602 and 603 coupled in parallel. The branch 601 comprises at least one capacitive element 641 and a switch 6431.

The branch 602 comprises a switch 6433. The branch 603 comprises at least one inductive element 642 and a switch 6432. By controlling the switches 6431, 6432 and 6433, the control circuit 64 selects one of the branches 601, 602 and 603, and couples the first portion 1310 of the second radiation element 13 through the selected branch to the second portion 1320 of the second radiation element 13. If the switch 6431 is closed and the switches 6432 and 6433 are opened, the first portion 1310 of the second radiation element 13 will be coupled through the capacitive element 641 to the second portion 1320 of the second radiation element 13. If the switch 6432 is closed and the switches 6431 and 6433 are opened, the first portion 1310 of the second radiation element 13 will be coupled through the inductive element 642 to the second portion 1320 of the second radiation element 13. If the switch 6433 is closed and the switches 6431 and 6432 are opened, the first portion 1310 of the second radiation element 13 will be directly coupled to the second portion 1320 of the second radiation element 13. As described above, the control circuit 64 can provide at least three different impedances. Other features of the communication device 600 in the fifth embodiment are similar to those in the first embodiment. Accordingly, the performance of the communication device 600 in the fifth embodiment is almost the same as that in the first embodiment.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna element, comprising:

a first radiation element, wherein one end of the first radiation element is coupled to a signal source, and another end of the first radiation element is an open end;

a second radiation element, comprising at least a first portion having a first end and a second end, and a second portion having a third end and a fourth end, wherein the first end of the first portion of the second radiation element is a shorted end coupled to the ground element, the fourth end of the second portion of the second radiation element is an open end, a length of the second radiation element is greater than a length of the first radiation element, and the second radiation element surrounds the open end of the first radiation element; and a control circuit, coupled between the second end of the first portion and the third end of the second portion of the second radiation element, wherein the control circuit provides at least two different impedances in such a manner that the antenna element operates in multiple bands.

2. The communication device as claimed in claim 1, wherein the control circuit is substantially located at a surface current null of a high-order resonant mode of the second radiation element.

3. The communication device as claimed in claim 1, wherein the control circuit comprises at least one capacitive element for providing at least two different capacitances.

4. The communication device as claimed in claim 3, wherein the control circuit further comprises an inductive element coupled in series to the capacitive element.

5. The communication device as claimed in claim 4, wherein the second radiation element further comprises a third portion, and the inductive element is coupled in series through the third portion of the second radiation element to the capacitive element.

6. The communication device as claimed in claim 3, wherein the capacitive element is a variable capacitor.

7. The communication device as claimed in claim 1, wherein the control circuit comprises a plurality of branches in parallel, the branches comprise at least one capacitive element and at least one inductive element, and the control circuit selects one of the branches and couples the first portion of the second radiation element through the selected branch to the second portion of the second radiation element.

8. The communication device as claimed in claim 1, wherein the antenna element operates in at least a first band and a second band, the first band is lower than the second band, and the first band is controlled by the control circuit so as to cover different frequency ranges.

9. The communication device as claimed in claim 8, wherein the first band covers a frequency range from about 700 MHz to 960 MHz.

10. The communication device as claimed in claim 8, wherein the second band covers a frequency range from about 1710 MHz to 2690 MHz.

* * * * *